US007762441B1

(12) United States Patent
Benally

(10) Patent No.: US 7,762,441 B1
(45) Date of Patent: Jul. 27, 2010

(54) CARRYING DEVICE

(76) Inventor: Jerrold L. Benally, 7400 S. State St., Midvale, UT (US) 84047

( * ) Notice: Subject to any disclaimer, the term of this patent is extended or adjusted under 35 U.S.C. 154(b) by 992 days.

(21) Appl. No.: 11/518,474

(22) Filed: Sep. 8, 2006

(51) Int. Cl.
*A45F 3/14* (2006.01)
*A45F 5/00* (2006.01)

(52) U.S. Cl. ..... 224/257; 224/258; 224/268; 224/269

(58) Field of Classification Search ..... 224/257, 224/258, 268, 269, 917
See application file for complete search history.

(56) References Cited

U.S. PATENT DOCUMENTS 3,377,007 A * 4/1968 Gayler, Jr. ..... 224/609
3,998,367 A * 12/1976 Harding ..... 224/625
5,165,584 A * 11/1992 Meagher et al. ..... 224/258
5,370,286 A * 12/1994 Newman ..... 224/578
5,437,401 A * 8/1995 Seltzer ..... 224/578
5,695,101 A * 12/1997 Frietze ..... 224/250
5,762,242 A * 6/1998 Yost ..... 224/250
6,371,346 B1 * 4/2002 Sharma ..... 224/578
6,637,077 B2 * 10/2003 Doty ..... 24/302

* cited by examiner

*Primary Examiner*—Nathan J Newhouse
*Assistant Examiner*—Lester L Vanterpool

(57) ABSTRACT

A carrying device is disclosed. An illustrative embodiment of the carrying device includes a main strap unit having a first loop strap segment and a first shoulder strap segment extending from the first loop strap segment. An attachment strap unit having a second loop strap segment and a second shoulder strap segment extending from the second loop strap segment is detachably carried by the first shoulder strap segment of the main strap unit. An apparatus and a method of carrying a snowboard are also disclosed.

14 Claims, 3 Drawing Sheets

CARRYING DEVICE

FIELD

The present invention relates to carrying devices. More particularly, the present invention relates to a strap-type carrying device which is particularly suitable for carrying a snowboard in a secure and comfortable manner.

BACKGROUND

Snowboarding has gained tremendous popularity in recent years. A typical snowboard has an elongated shape and is fitted with straps for attaching the snowboard onto the feet of a snowboarder. The snowboarder slides down a ski slope in a series of back-and-forth movements which requires a level of proficiency. Before and after snowboarding, the snowboarder typically must carry the snowboard to and from the ski slope. However, due to its size, the snowboard is typically awkward to carry.

SUMMARY

The present invention is generally directed to a carrying device. An illustrative embodiment of the carrying device includes a main strap unit having a first loop strap segment and a first shoulder strap segment extending from the first loop strap segment. An attachment strap unit having a second loop strap segment and a second shoulder strap segment extending from the second loop strap segment is detachably carried by the first shoulder strap segment of the main strap unit.

BRIEF DESCRIPTION OF THE DRAWINGS

The invention will now be described, by way of example, with reference to the accompanying drawings, in which.

DETAILED DESCRIPTION

Figure 1:
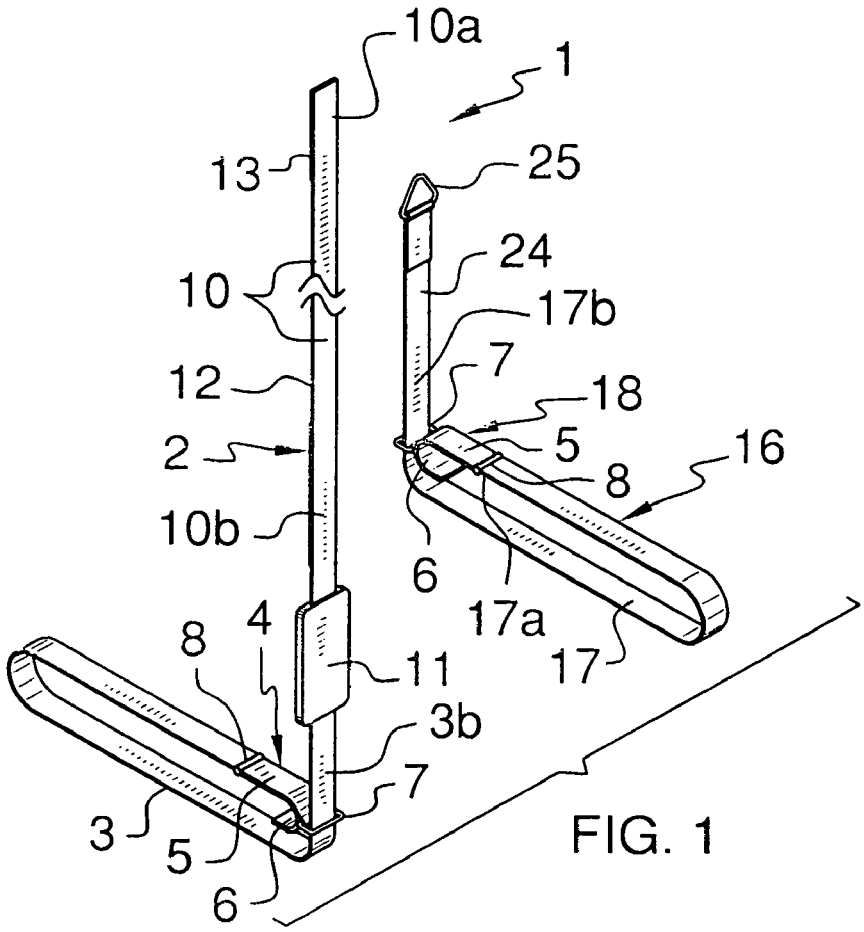
FIG. 1 is a perspective view of an illustrative embodiment of the carrying device.

Referring to the drawings, an illustrative embodiment of the carrying device is generally indicated by reference numeral 1. The carrying device 1 typically includes a main strap unit 2 and an attachment strap unit 16 which are adapted to be attached to a snowboard 30 (FIGS. 3 and 4), for example, and to each other, typically in a manner which will be hereinafter described, to facilitate secure and comfortable carrying of the snowboard 30.

The main strap unit 2 of the carrying device 1 includes an elongated loop strap segment 3 which may be nylon webbing, for example, and has a proximal end 3*a* and an extending or distal end 3*b*. An elongated shoulder strap segment 10 is typically continuous with the distal end 3*b* of the loop strap segment 3. A shoulder pad 11 may be provided on the shoulder strap segment 10 for purposes which will be hereinafter described. An attachment mechanism is provided on the shoulder strap segment 10 to facilitate detachable attachment of a distal end segment 10*a* to a proximal end segment 10*b* of the shoulder strap segment 10. For example, complementary hook and loop fasteners 12 and 13, respectively, may be provided on the proximal end segment 10*b* and the distal end segment 10*a*, respectively, of the shoulder strap segment 10 in spaced-apart relationship with respect to each other.

Figure 2:
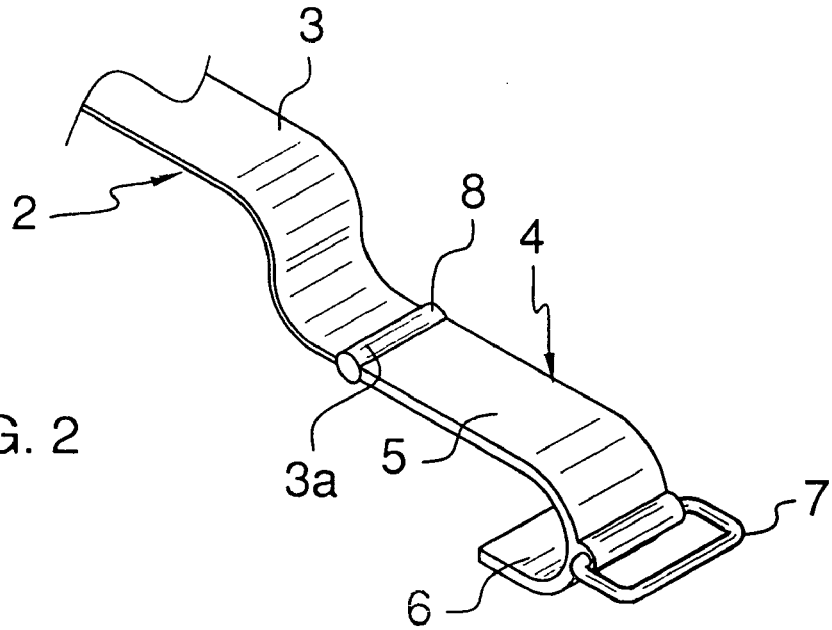
FIG. 2 is an enlarged sectional view of a leverage clip attached to a loop strap segment element of the carrying device.

A leverage clip 4 is provided on the proximal end 3*a* of the loop strap segment 3. As shown in FIG. 2, the leverage clip 4 typically includes a clip arm 5 which is attached to the loop strap segment 3 at a pivot point 8. A curved clip hook 6 extends from the clip arm 5. A clip ring 7 is attached to the clip hook 6. The distal end 3*b* of the loop strap segment 3 extends through the clip ring 7, imparting a generally loop-shaped configuration to the loop strap segment 3.

The attachment strap unit 16 includes a loop strap segment 17 which may be nylon webbing, for example, and has a proximal end 17*a* and an extending or distal end 17*b*. An elongated shoulder strap segment 24 is typically continuous with the distal end 17*b* of the loop strap segment 17. An attachment ring 25, the purpose of which will be hereinafter described, terminates the shoulder strap segment 24.

Figure 4:
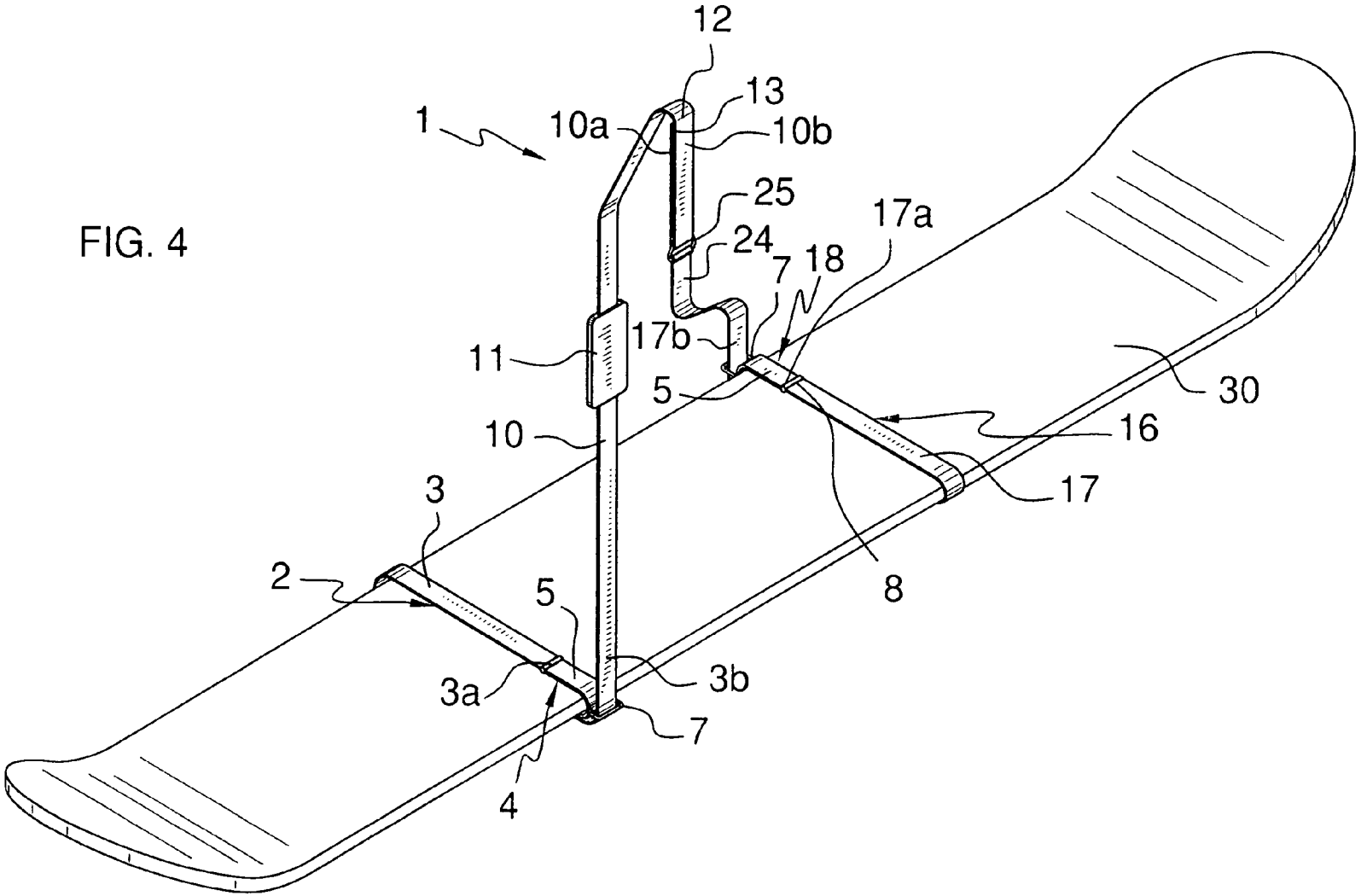
FIG. 4 is a perspective view an illustrative embodiment of the carrying device, attached to a snowboard.

A leverage clip 18, typically having the same construction as the leverage clip 4 of the main strap unit 2, is provided on the proximal end 17*a* of the loop strap segment 17. The distal end 17*b* of the loop strap segment 17 extends through the clip ring 7 of the leverage clip 18, imparting a generally loop-shaped configuration to the loop strap segment 17. As shown in FIG. 4, the shoulder strap segment 10 of the main strap unit 2 can be attached to the shoulder strap segment 24 of the attachment strap unit 16 by extending the shoulder strap segment 10 through the attachment ring 25 provided on the end of the shoulder strap segment 24 and then attaching the hook and loop fastener 13 on the shoulder strap segment 10 to the complementary hook and loop fastener 12 on the shoulder strap segment 10.

Figure 3:
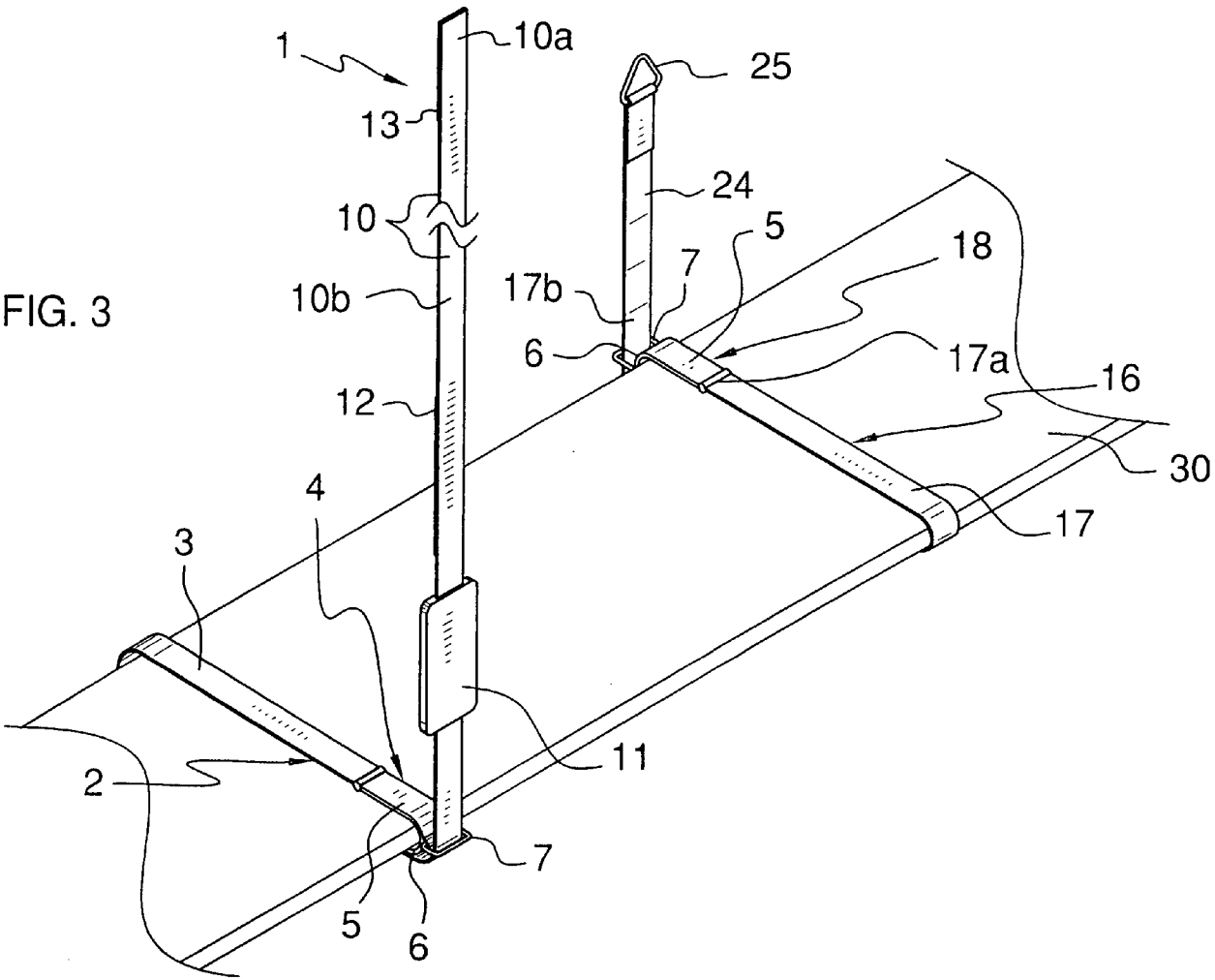
FIG. 3 is a perspective view, partially in section, of an illustrative embodiment of the carrying device, illustrating a typical manner of attachment of the carrying device to a snowboard.

As shown in FIGS. 3 and 4, in typical application, the carrying device 1 is attached to a snowboard 30 to facilitate carrying of the snowboard 30 in a secure and comfortable manner. Accordingly, the loop strap segment 3 of the main strap unit 2 is extended over one end, and the loop strap segment 17 of the attachment strap unit 16 is extended over the opposite end, of the snowboard 30. After the main strap unit 2 and the attachment strap unit 16 are positioned in adjacent relationship with respect to each other on the snowboard 30, the shoulder strap segment 10 of the main strap unit 2 is attached to the shoulder strap segment 10 of the attachment strap unit 16. This is accomplished typically by extending the distal end segment 10*a* of the shoulder strap segment 10 through the attachment ring 25 of the shoulder strap segment 24 and then attaching the distal end segment 10*a* to the proximal end segment 10*b* of the shoulder strap segment 10. Accordingly, as shown in FIG. 4, the shoulder strap segment 10 of the main strap unit 2 and the shoulder strap segment 24 of the attachment strap unit 16 can be positioned over the shoulder (not shown) of a snowboarder (not shown) to facilitate carrying of the snowboard 30. The shoulder pad 11 on the shoulder strap segment 10 can be placed on the shoulder of the snowboarder for comfort. Due to the leverage clip 4 provided on the main strap unit 2 and the leverage clip 18 on the attachment strap unit 16, the loop strap segment 3 and the loop strap segment 17 are tightened around the snowboard 30 by gravity as the snowboard 30 is carried by the carrying device 30. The carrying device 1 is detached from the snowboard 30 by detaching the shoulder strap segment 10 of the main strap unit 2 from the shoulder strap segment 24 of the attachment strap unit 16 and then sliding the main strap unit 2 and the attachment strap unit 16 from the respective ends of the snowboard 30.

While the preferred embodiments of the invention have been described above, it will be recognized and understood that various modifications can be made in the invention and the appended claims are intended to cover all such modifications which may fall within the spirit and scope of the invention.

What is claimed is:

1. A carrying device, comprising:

a main strap unit having a first loop strap segment and a first shoulder strap segment extending from said first loop strap segment;

an attachment strap unit having a second loop strap segment and a second shoulder strap segment extending from said second loop strap segment and detachably carried by said first shoulder strap segment of said main strap unit; and a first leverage clip provided on said first loop strap segment and a second leverage clip provided on said second loop strap segment, and wherein said first shoulder strap segment is engaged by said first leverage clip and said second shoulder strap segment is engaged by said second leverage clip, wherein said first leverage clip and said second leverage clip comprises a clip arm carried by a corresponding one of said first loop strap segment and said second loop strap segment; a clip hook extending from said clip arm; and a clip ring carried by said clip hook.

2. The carrying device of claim 1 further comprising a shoulder pad carried by said first shoulder strap segment.

3. The carrying device of claim 1 further comprising an attachment mechanism carried by said first shoulder strap segment.

4. The carrying device of claim 3 wherein said attachment mechanism comprises hook and loop fasteners.

5. The carrying device of claim 1 further comprising an attachment ring provided on said second shoulder strap segment and wherein said first shoulder strap segment extends through said attachment ring.

6. An apparatus, comprising:

a snowboard;

a main strap unit having a first loop strap segment extending around said snowboard and a first shoulder strap segment extending from said first loop strap segment;

an attachment strap unit having a second loop strap segment extending around said snowboard and a second shoulder strap segment extending from said second loop strap segment and detachably carried by said first shoulder strap segment of said main strap unit; and a first leverage clip provided on said first loop strap segment and a second leverage clip provided on said second loop strap segment, and wherein said first shoulder strap segment is engaged by said first leverage clip and said second shoulder strap segment is engaged by said second leverage clip, wherein said first leverage clip and said second leverage clip comprises a clip arm carried by a corresponding one of said first loop strap segment and said second loop strap segment; a clip hook extending from said clip arm; and a clip ring carried by said clip hook.

7. The apparatus of claim 6 further comprising a shoulder pad carried by said first shoulder strap segment.

8. The carrying device of claim 6 further comprising an attachment mechanism carried by said first shoulder strap segment.

9. The carrying device of claim 8 wherein said attachment mechanism comprises hook and loop fasteners.

10. The carrying device of claim 6 further comprising an attachment ring provided on said second shoulder strap segment and wherein said first shoulder strap segment extends through said attachment ring.

11. A method of carrying a snowboard, comprising:

providing a main strap unit having a first loop strap segment and a first shoulder strap segment extending from said first loop strap segment;

providing an attachment strap unit having a second loop strap segment and a second shoulder strap segment extending from said second loop strap segment;

attaching said first loop strap segment and said second loop strap segment to the snowboard;

attaching said first shoulder strap segment to said second shoulder strap segment; and providing a first leverage clip on said first loop strap segment and providing a second leverage clip on said second loop strap segment, engaging said first shoulder strap segment by said first leverage clip, and engaging said second shoulder strap segment by said second leverage clip, wherein said first leverage clip and said second leverage clip comprises a clip arm carried by a corresponding one of said first loop strap segment and said second loop strap segment; a clip hook extending from said clip arm; and a clip ring carried by said clip hook.

12. The method of claim 11 further comprising providing a shoulder pad on said first shoulder strap segment.

13. The method of claim 11 further comprising providing an attachment mechanism on said first shoulder strap segment.

14. The method of claim 13 further comprising an attachment mechanism comprises hook and loop fasteners.

* * * * *